US012396509B2

(12) United States Patent
Tolk et al.

(10) Patent No.: US 12,396,509 B2
(45) Date of Patent: Aug. 26, 2025

(54) SAFETY HELMET WITH AN INTERMEDIATE PIECE FOR CHANGING THE CENTER OF GRAVITY AND ARRANGEMENTS WITH SUCH A SAFETY HELMET AND TWO ALTERNATIVE INTERMEDIATE PIECES

(71) Applicant: Dräger Safety AG & Co. KGaA, Lübeck (DE)

(72) Inventors: Siegbert Tolk, Lübeck (DE); Jasser Rahmatyan, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 841 days.

(21) Appl. No.: 17/242,974

(22) Filed: Apr. 28, 2021

(65) Prior Publication Data

US 2021/0337909 A1 Nov. 4, 2021

(30) Foreign Application Priority Data

Apr. 30, 2020 (DE) ..... 102020002616.8

(51) Int. Cl.
*A42B 3/14* (2006.01)

(52) U.S. Cl.
CPC ..... *A42B 3/142* (2013.01)

(58) Field of Classification Search
CPC ..... A42B 3/142; A42B 3/145; A42B 3/14; A42B 3/147; A43B 3/142
USPC ..... 2/417
See application file for complete search history.

(56) References Cited

U.S. PATENT DOCUMENTS 3,388,405 A * 6/1968 Simpson ..... A42B 3/142 2/418
3,495,272 A 2/1970 Hermann
4,999,846 A * 3/1991 Ball ..... A42B 1/22 2/418
5,373,588 A 12/1994 Hede et al.
5,603,120 A * 2/1997 Gifford ..... A42B 3/105 2/172

(Continued)

FOREIGN PATENT DOCUMENTS

CN 103096747 A 5/2013
CN 106572715 A 4/2017

(Continued)

OTHER PUBLICATIONS

NPL Translation—Apr. 8, 2010 Seigbert T.*

*Primary Examiner* — Alissa J Tompkins
*Assistant Examiner* — Catherine M Ferreira
(74) *Attorney, Agent, or Firm* — McGlew and Tuttle, P.C.

(57) ABSTRACT

A safety helmet (100) includes an arched helmet shell (7), a front holding element (2) attached to the helmet shell (7) and a curved front bearing element (5). The front bearing element lies flat against the forehead of a user of the safety helmet (100). A rigid intermediate piece (1) bridges a distance between the front holding element (2) and the front bearing element (5). This intermediate piece (1) is mechanically connected to the front holding element (2) and to the front bearing element (5), wherein at least one connection is detachable. The present invention pertains, furthermore, to two arrangements with such a safety helmet and with two alternative intermediate pieces or with two alternative front bearing elements with a respective intermediate piece.

7 Claims, 12 Drawing Sheets

(56) References Cited

U.S. PATENT DOCUMENTS

| | | | | |
|---|---|---|---|---|
| 7,174,575 | B1 | 2/2007 | Scherer | |
| 2008/0295229 | A1 | 12/2008 | Fang | |
| 2009/0320186 | A1* | 12/2009 | Petzl | A42B 3/145 2/417 |
| 2010/0050325 | A1 | 3/2010 | Wang-Lee | |
| 2017/0112222 | A1* | 4/2017 | Gotti | A42B 3/08 |
| 2017/0251746 | A1* | 9/2017 | Staudinger | A42B 3/08 |
| 2019/0045871 | A1* | 2/2019 | Stade | A42B 3/142 |
| 2019/0231018 | A1* | 8/2019 | Boutin | A42B 3/124 |

FOREIGN PATENT DOCUMENTS

| | | | | | |
|---|---|---|---|---|---|
| CN | 106998840 | A | | 8/2017 | |
| CN | 207808499 | U | | 9/2018 | |
| DE | 847811 | C | | 8/1952 | |
| DE | 911545 | C | | 5/1954 | |
| DE | 921 777 | C | | 12/1954 | |
| DE | 18 70 098 | U | | 4/1963 | |
| DE | 40 22 422 | A1 | | 3/1991 | |
| DE | 198 82 440 | B4 | | 11/2006 | |
| DE | 102008047980 | A1 | * | 4/2010 | A42B 3/14 |
| DE | 10 2010 052 725 | B3 | | 3/2012 | |
| DE | 102016008025 | A1 | | 1/2018 | |
| DE | 102016010532 | A1 | | 3/2018 | |
| DE | 102016010534 | A1 | | 3/2018 | |
| DE | 102019008045 | A1 | | 5/2021 | |
| EP | 3177163 | B1 | | 1/2019 | |
| EP | 3530134 | A1 | | 8/2019 | |
| GB | 2544482 | A | * | 5/2017 | A42B 3/063 |
| KR | 20170061639 | A | * | 6/2017 | |
| KR | 102474432 | B1 | * | 12/2022 | |
| WO | 2017147354 | A1 | | 8/2017 | |
| WO | WO-2017152151 | A1 | * | 9/2017 | A42B 3/064 |
| WO | 2019162073 | A1 | | 8/2019 | |

* cited by examiner

SAFETY HELMET WITH AN INTERMEDIATE PIECE FOR CHANGING THE CENTER OF GRAVITY AND ARRANGEMENTS WITH SUCH A SAFETY HELMET AND TWO ALTERNATIVE INTERMEDIATE PIECES

CROSS REFERENCE TO RELATED APPLICATIONS

This application claims the benefit of priority under 35 U.S.C. § 119 of German Application 10 2020 002 616.8, filed Apr. 30, 2020, the entire contents of which are incorporated herein by reference.

TECHNICAL FIELD

The present invention pertains to a safety helmet comprising an arched helmet shell, a holding element attached to the helmet shell and a curved front bearing element. The front bearing element lies against the forehead of a user of the safety helmet. The present invention pertains, furthermore, to two arrangements with such a safety helmet.

TECHNICAL BACKGROUND

The front bearing element may belong to a bearing ring, which encompasses the head of user of the safety helmet. Such a safety helmet is known, for example, from DE 10 2008 047 980 A1. The safety helmet 1 described there comprises a helmet shell 2, an inner bearing ring 3, an outer bearing ring 4 and three connection parts 5, which are configured each as a strap 6. The outer bearing ring 4 is attached on the inside to the helmet shell 2 by means of a connection device 10, for example, by means of three screws 11 or three rivets. The inner bearing ring 3 is in contact (areal contact) with the head of a user.

The steel helmet a from DE 847811 C comprises a helmet shell (wall), an attaching ring c, a bearing ring d, which is in contact with the head of a user, and a helmet inner lining e. The attaching ring c is attached to the inner wall of the steel helmet by means of three cotter pins. A plurality of springs f on the inside at the attaching ring c carry the bearing ring d.

The safety helmet from EP 3177163 B1 comprises a helmet shell and a bearing support structure. The entire bearing support structure can be displaced relative to the helmet shell.

SUMMARY

A basic object of the present invention is to provide a safety helmet, which guarantees good seating on the head of a user of the safety helmet with a higher reliability than do prior-art safety helmets.

Advantageous embodiments of the safety helmet according to the present invention are, where meaningful, also advantageous embodiments of an arrangement according to the present invention and vice versa.

The safety helmet according to the present invention comprises an arched helmet shell, a front holding element, a curved front bearing element and a rigid intermediate piece. The front holding element is attached to the helmet shell, so that it cannot perform any appreciable movement relative to the helmet shell when the safety helmet is sitting on the head of a user.

The arched helmet shell encompasses (encloses) an area in which the front holding element, the front bearing element and the intermediate piece as well as optionally additional components of the safety helmet are arranged.

The intermediate piece is mechanically connected to the front holding element and to the front bearing element or can be connected to both mechanically. In a first alternative, the intermediate piece can consequently be separated from the front holding element. In a second alternative, the intermediate piece can be separated from the front bearing element.

When a person (hereinafter called "the user") is wearing the safety helmet on the user's head, the front bearing element is in contact with (lies flat against) the head of the user in an area, which is located in front of the forehead of the user. The designations "in the front," "front," "rear," "in the rear" as well as "left" and "right" pertain to the usual orientations when the user is wearing the safety helmet on the user's head and is looking straight forward.

A distance is formed between the front holding element, which is attached to the helmet shell, and the front bearing element, which is in contact with the forehead. The rigid intermediate piece bridges this distance between the front holding element and the front bearing element.

The intermediate piece makes it easier for the front bearing element to be in contact with the head of the user, and the front holding element is attached on the inside to the helmet shell. The front bearing element may belong to (be a part of) a bearing ring, which fully encompasses the head of the user. This bearing ring may have a variable length, so that the head size provided by the safety helmet can be changed. Thanks to the intermediate piece, the helmet shell and the front holding element do not need to be changed when changing the head size.

In one embodiment, the intermediate piece is permanently connected (fixed) to the bearing element and is detachably connected to the front holding element. The intermediate piece and the front bearing element preferably form a single component. The detachable connection between the intermediate piece and the front holding element is preferably established by means of a snap connection or a snap-in connection. This embodiment makes it possible to connect the intermediate piece to the front holding element and to separate it again from this without necessarily having to use a tool for this purpose.

In another embodiment, the intermediate piece is permanently connected (fixed) to the front holding element and detachably connected to the front bearing element. The intermediate piece and the front holding element preferably form a single component. The detachable connection between the intermediate piece and the front bearing element is preferably established by means of a snap connection or a snap-in connection.

According to the present invention, the front bearing element is flatly in contact with the forehead of a user of the safety helmet. As a result, the front bearing element contributes to holding the safety helmet securely on the head of the user and to reducing the risk of the safety helmet undesirably slipping on the head of the user.

A distance is formed according to the present invention between the front holding element and the front bearing element. As a result, the front holding element and hence also the helmet shell are not directly in contact with the forehead of the user. Air may rather enter in many cases into the area between the helmet shell and the head and contribute to the cooling of the head of the user, which is especially advantageous when the safety helmet is used in an environment with a high temperature, for example, in case of a fire.

The front bearing element is connected according to the present invention by a rigid intermediate piece to the front holding element. The front holding element is attached on the inside to the helmet shell. Thanks to the rigid intermediate piece, the front holding element cannot perform any appreciable movements relative to the front bearing element. Compared to a flexible or elastic intermediate piece, the embodiment with the rigid intermediate piece reduces the risk of movement of the helmet shell relative to the front bearing element in an undesired manner.

The intermediate piece is connected according to the present invention to the front bearing element and to the front holding element. The intermediate piece can be separated from the front bearing element and/or from the front holding element. It is made possible hereby to use the safety helmet optionally with at least two different intermediate pieces, wherein an intermediate piece is inserted into the safety helmet and wherein these intermediate pieces differ in respect to at least one dimension. These intermediate pieces bridge different distances between the front bearing element and the front holding element. The feature that different distances can be bridged by a respective intermediate piece is especially advantageous when a plurality of safety helmets of identical configuration according to the present invention shall be used for a plurality of users with different head sizes and/or head shapes.

The distance between the front holding element and the front bearing element, which is bridged by an intermediate piece, contributes to the positioning of the center of gravity of the safety helmet relative to the head of a user. The position of the center of gravity is also a factor deciding how good the wear comfort of the safety helmet is. If the center of gravity is eccentric relative to the head, the user of the safety helmet must steadily exert a force in the user's neck muscles and/or the user's nape muscles to look straight forward and to wear the safety helmet in a desired manner on the user's head. The necessity to have to steadily exert this force stresses and fatigues the user and is therefore non-ergonomic and undesired. Where the center of gravity of the safety helmet is positioned relative to the head also depends on the position of the front bearing element relative to the front holding element. The distance between these two elements can be bridged within certain limits by a matching intermediate piece and thus set.

The front bearing element is preferably manufactured from a flexible material. As a result, the front bearing element can adapt itself to the shape of the head of a user of the safety helmet.

In a preferred embodiment, the intermediate piece is permanently connected (fixed) to the front bearing element and detachably to the front holding element, especially preferably by means of a snap connection or snap-in connection. This preferred embodiment makes it possible to replace the intermediate piece together with the front bearing element and to use a new intermediate piece with a different dimension. As a result, the distance between the front bearing element and the front holding element can be changed. It is not necessary to remove or even replace another component of the safety helmet.

It is relatively easy in many cases to insert the front bearing element along with a permanently connected intermediate piece into the safety helmet and to connect the intermediate piece to the front holding element. In a possible embodiment, the front bearing element is held only by the intermediate piece in the safety helmet. This embodiment makes it easier in many cases to clean a textile sheathing of the front bearing element. Thanks to such a textile sheathing, the front bearing element does not come directly into contact with the head of a user.

In another embodiment, the intermediate piece is connected both detachably to the front holding element and detachably to the front bearing element. The intermediate piece can be replaced as a result separately and be replaced by a differently dimensioned intermediate piece. It is likewise unnecessary in this embodiment to remove or even replace another component of the safety helmet.

The safety helmet preferably comprises additionally two rear bearing elements as well as a rear holding structure comprising a rear holding element. The rear holding element is permanently connected (fixed) to the helmet shell. Each rear bearing element is mechanically connected directly to the rear holding structure comprised of the rear holding element or comprised of two rear holding elements. "Directly connected" means: Without an intermediate piece bridging over a distance between the rear bearing element and the rear holding element(s).

The front bearing element is mechanically connected to the two rear bearing elements. In one embodiment, the respective mechanical connection between the front bearing element and a rear bearing element can be severed again. This detachable connection is preferably established by means of a snap connection or a snap-in connection, so that no tool is needed to establish and sever this connection. In another embodiment, the front bearing element is permanently connected (fixed) to both rear bearing elements.

The front bearing element and the two rear bearing elements form together a bearing ring when they are connected to one another. This bearing ring encompasses the head of a user of the safety helmet. The bearing ring sets the head size provided by the safety helmet. Both the front bearing element and the two rear bearing elements are preferably made of at least one flexible material, so that the bearing ring can be adequately adapted to the shape of the head of a user.

In a variant of this embodiment, the head size provided can be changed. According to this variant, the safety helmet comprises a rotatable actuating element, preferably a handwheel, which is accessible from the outside. At least one rear bearing element can be moved relative to the other rear bearing element. Both rear bearing elements can preferably be moved relative to the helmet shell, especially preferably in opposite directions. A rotation of the actuating element relative to the helmet shell causes the one rear bearing element to be moved relative to the other rear bearing element. The head size, which the bearing ring provides, is changed thereby. Depending on the rotation direction, the head size provided is increased or decreased.

The effect of this embodiment that the head size provided can be changed has especially the following advantages: A plurality of safety helmets according to the present invention of an identical design can be used by users with heads of different sizes and/or different shapes. In addition, a user can use the same safety helmet according to the present invention optionally with or without a head cover on the user's head. The head cover is located between the head of the user and the safety helmet and requires the safety helmet to provide a larger head size than in case of a use without head cover.

In one embodiment, the safety helmet comprises in addition to the intermediate piece at least one additional intermediate piece. A distance is formed between these two intermediate pieces. Each intermediate piece is mechanically connected to the front holding element and is mechanically connected to the front bearing element, and at least one respective connection is a detachable connection. Thanks to this embodiment, the front bearing element is connected to the front holding element at at least two mutually spaced connection points. This leads to an even better seating and to an even higher mechanical stability of the safety helmet.

In one embodiment, an extent of the intermediate piece does not change, but it remains constant. In another embodiment, an extent of the intermediate piece can be changed in one direction, i.e., along an axis, from the front bearing element to the front holding element. It is also possible as a result to change the distance between the front holding element and the front bearing element without another intermediate piece having to be used. This embodiment makes it possible even better to change and to adjust the center of gravity of the safety helmet on the head of a user.

The present invention pertains, furthermore, to an arrangement which comprises a safety helmet, a first rigid intermediate piece and a second rigid intermediate piece, i.e., two alternatively usable rigid intermediate pieces. The safety helmet comprises an arched helmet shell, a front holding element and a curved front bearing element. The front holding element is attached to the helmet shell. The front bearing element is flatly in contact with the head of the user in an area in front of the forehead of the user.

The just mentioned advantageous embodiments of the safety helmet according to the present invention may also be advantageous embodiments of this arrangement.

Both the first intermediate piece and the second intermediate piece can be mechanically connected to the front holding element, the connection being a detachable one. Both the first intermediate piece and the second intermediate piece can be mechanically connected detachably to the front bearing element.

The arrangement can be used optionally in a first configuration or in a second configuration. A first distance is formed between the front holding element and the front bearing element in the first configuration. A second distance, which is different from the first distance, is formed between the front holding element and the front bearing element in the second configuration. The difference between the distances results especially from two different head sizes provided.

The first intermediate piece is mechanically connected in the first configuration to the front holding element and to the front bearing element, the connection being a detachable one. The first intermediate piece bridges the first distance. The second intermediate piece is not necessarily used in the first configuration and is not necessarily connected to a component of the safety helmet.

In the second configuration, the second intermediate piece is mechanically connected to the front holding element and to the front bearing element, the connection being a detachable connection. The second intermediate piece bridges the second distance. The dimension that the second intermediate piece has when viewed in a direction from the front holding element to the front bearing element differs from the dimension of the first intermediate piece in this direction. The first intermediate piece is not necessarily used in the second configuration and it is also not necessarily connected to a component of the safety helmet.

Consequently, the safety helmet can be used optionally with the first intermediate piece or with the second intermediate piece. The center of gravity of the safety helmet relative to the head of a user can be adapted. The advantages of this procedure were already explained farther above.

In one embodiment, the arrangement may be used additionally in a third configuration. No distance is formed between the front holding element and the front bearing element in this third configuration. The front bearing element rather adjoins the front holding element directly in an area. The front bearing element is connected directly mechanically detachably to the front holding element in this area. This third configuration can be used especially to provide an especially large head size.

The present invention further pertains to an arrangement comprising

- a safety helmet,
- a first curved front bearing element and a second curved front bearing element, as well as
- a first rigid intermediate piece and a second rigid intermediate piece.

The arrangement consequently comprises two alternative curved front bearing elements with a respective rigid intermediate piece each.

The safety helmet comprises an arched helmet shell and a front holding element, which is attached to the helmet shell. The first intermediate piece is permanently connected (fixed) to the first front bearing element. The first intermediate piece and the first front bearing element preferably form one component. The second intermediate piece is permanently connected (fixed) to the second front bearing element. The second intermediate piece and the second front bearing element preferably form one component.

The arrangement can optionally be used in a first configuration or in a second configuration.

In the first configuration, the first front bearing element and the first intermediate piece are inserted into the safety helmet and they are located in the interior of the helmet shell. The first intermediate piece is detachably connected to the front holding element. A first distance is formed between the first front bearing element and the front holding element. The first intermediate piece bridges this first distance. The first front bearing element is located in front of the forehead of a user of the safety helmet. The second front bearing element and the second intermediate piece are not necessarily used in the first configuration and they are not necessarily connected to the safety helmet.

In the second configuration, the second front bearing element and the second intermediate piece are inserted into the safety helmet and are located in the interior of the helmet shell. The second intermediate piece is detachably connected to the front holding element. A second distance, which is different from the first distance, is formed between the second front bearing element and the front holding element. The second intermediate piece bridges this second distance. The second front bearing element is located in front of the forehead of a user of the safety helmet. The first front bearing element and the first intermediate piece are not necessarily used in the second configuration and they are not necessarily connected to the safety helmet.

In a preferred embodiment, the curved front bearing element or each curved front bearing element has the shape of a circular segment or of an elliptical segment. When a user is wearing the safety helmet on the user's head, the front bearing element fully encompasses the forehead of the user.

In a preferred embodiment, the front bearing element or each front bearing element is enclosed by a textile sheathing. When a user is wearing the safety helmet on the user's head, this textile sheathing is located between the front bearing element and the head of the user. The textile sheathing cushions the front bearing element and absorbs sweat. The textile sheathing can especially preferably be separated from the front bearing element and be cleaned separately from the rest of the safety helmet.

In one embodiment, at least the front holding element, the front bearing element and the rigid intermediate piece of a safety helmet according to the present invention are produced by at least one 3D printer. Different components of the safety helmet are optionally produced by different 3D printers, also at different locations. According to this embodiment, at least the front holding element, the front bearing element or each front bearing element and the at least two intermediate pieces of an arrangement according to the present invention are also produced by a 3D printer. The helmet shell is likewise produced by a 3D printer in one embodiment and according to another manufacturing process in another embodiment. The components are preferably assembled to a safety helmet according to the present invention.

The present invention pertains, on the one hand, to a 3D printer, which is configured to produce the just mentioned components of a safety helmet according to the present invention and of an arrangement according to the present invention. On the other hand, the present invention pertains to a computer program, which can be executed on a computer. If the computer program is executed on the computer, the computer actuates at least one 3D printer.

The actuated 3D printer produces the just listed components of the safety helmet according to the present invention. The computer optionally actuates a plurality of 3D printers, which produce different components of the safety helmet. It is also possible that different computer programs actuate a respective computer, wherein each actuated computer produces a respective component of the safety helmet according to the present invention.

The present invention will be described below on the basis of an exemplary embodiment. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
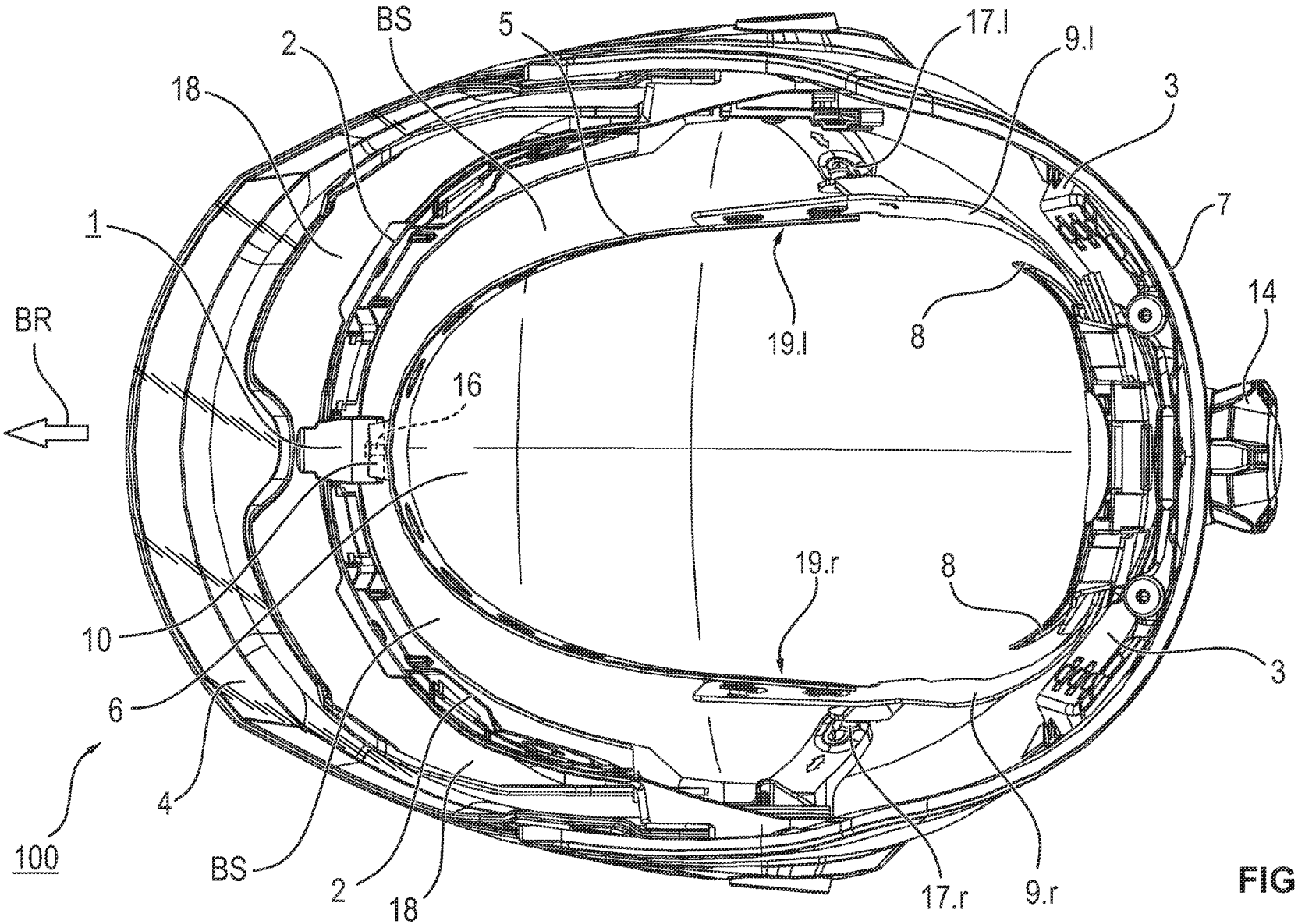
FIG. 1 is a perspective view showing a safety helmet vertically from below.
Figure 2:
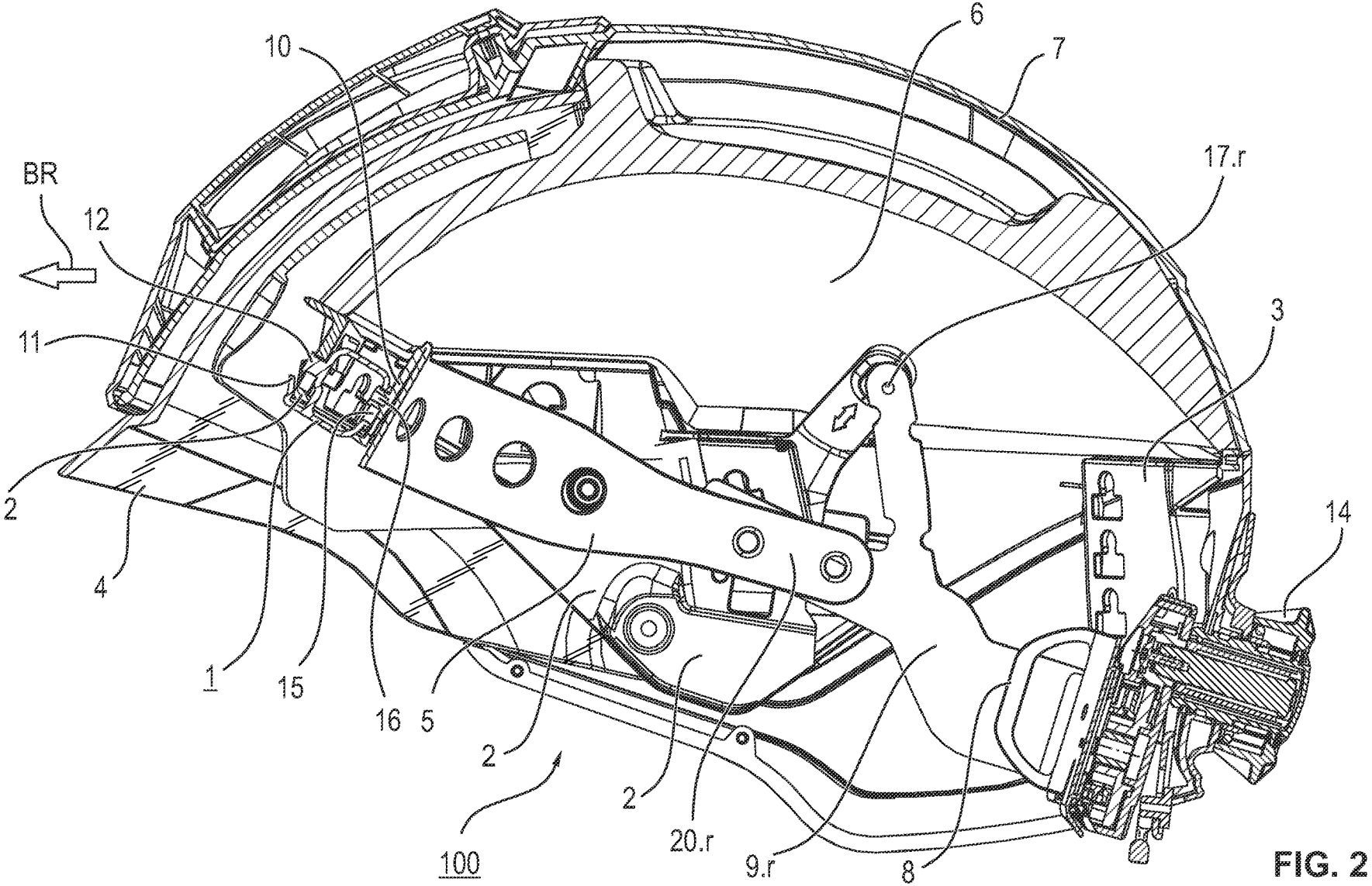
FIG. 2 is a cross-sectional view of the safety helmet, wherein the vertical section plane is parallel to the viewing direction of the user.

Referring to the drawings, the present invention pertains to a safety helmet, which is used by firefighters, police, rescue workers and other rescue team members in order better to protect the head of the user from mechanical, thermal and chemical effects.

The safety helmet according to the exemplary embodiment comprises, just like many other safety helmets, an arched helmet shell, which is preferably manufactured from a hard material, optionally an arched shock-absorbing shell in the interior of the helmet shell, a bearing structure and an inner lining. The inner lining is in contact with the head of a person, who is wearing this safety helmet on the user's head, and it comprises textile components. This person will hereinafter be called "the user."

The viewing direction BR of a user looking straight forward is shown in some figures. The inner lining is omitted in the figures.

The bearing structure connects the inner lining to the helmet shell and comprises a multipart bearing ring, which is placed at least partially around the head of the user. This bearing ring is so flexible that it can adapt itself to a certain extent to the shape of the head of the user. This flexible bearing ring shall be in contact with the head without a large clearance, on the one hand, in order for the safety helmet not to slip during use. On the other hand, the bearing ring shall not press the head. The bearing ring must therefore be able to be adapted to the head size of the user. The term "head size" of the bearing ring will hereinafter be used as well; it is the actual length of the bearing ring, which is in contact with the head of the user.

The safety helmet according to the exemplary embodiment therefore comprises—just like many prior-art safety helmets—an actuating unit with a handwheel, with which the head size can be changed manually. A rotation of the handwheel changes the length of the bearing ring.

The center of gravity of the safety helmet shall be arranged more or less fittingly relative to the head of the user in order for the user to need to exert as little force as possible especially in the nape with the head held straight upright in order to hold the user's head with the safety helmet on straight upright and to look in a desired direction, for example, straight forward or horizontally to the side. How the center of gravity of the safety helmet is positioned relative to the head depends, among other things, on the set head size as well as on the shape of the head and the size of the head of the user. The safety helmet according to the exemplary embodiment, which will be described below, makes it possible to change the center of gravity of the safety helmet in a relatively simple manner and thus to adapt it to the head of a user.

Figure 3:
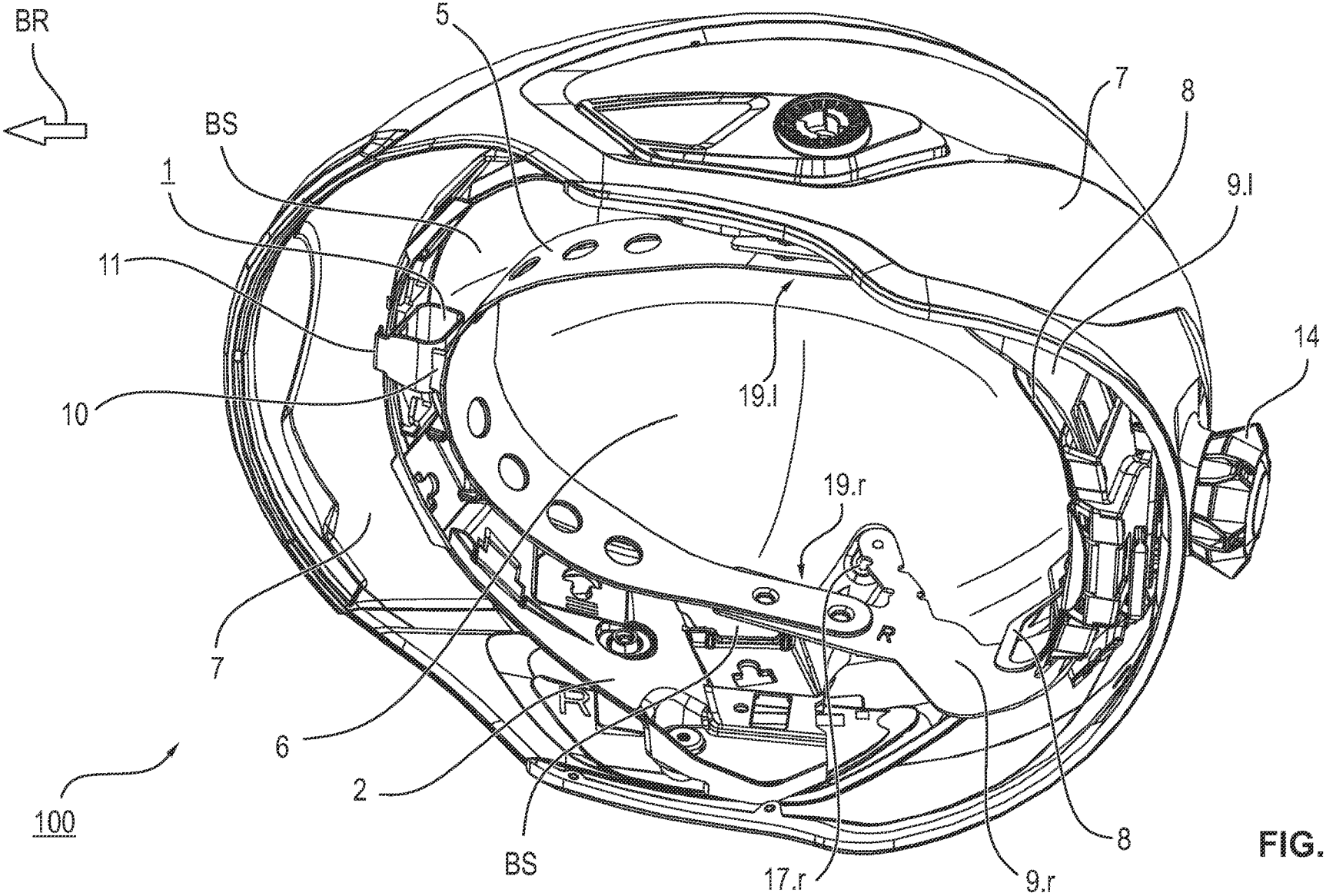
FIG. 3 is a perspective view showing the safety helmet from FIG. 1 obliquely from below, wherein the visor and the additional visor are omitted.

FIG. 1 shows the safety helmet 100 according to the exemplary embodiment in a viewing direction vertically from below, and FIG. 3 shows it obliquely from below. FIG.

2 shows a cross-sectional view of the safety helmet 100, wherein the vertical section plane extends in parallel to the viewing direction BR.

This safety helmet 100 comprises:

- an arched helmet shell 7, which is preferably manufactured from a hard material,
- an arched shock-absorbing shell 6, which is in contact on the inside with the helmet shell 7 and is manufactured from a plastically deformable material in order to absorb kinetic energy acting from the outside,
- a curved front holding element 2, which is flatly in contact with the shock-absorbing shell 6, is detachably connected to the helmet shell 7 and has the shape of a segment of an ellipse or of a horseshoe,
- a curved rear holding element 3, which is likewise flatly in contact on the inside with the shock-absorbing shell 6 and is detachably connected to the helmet shell 7,
- a pivotable visor 4, which is rotatably connected to the front holding element 2,
- sunglasses in the form of an additional visor 18, which is pivotably connected to the front holding element 2,
- a curved front bearing element 5, which is in contact with the forehead of the user and has the shape of a segment of an ellipse,
- a reinforcing piece 10, which is attached in the front centrally to the front bearing element 5 and has a mushroom-shaped projection 16,
- a central rear bearing element in the form of a bearing support 8 for the back of the head, which is in contact with the back of the head of the user, and
- a left rear bearing element 9.*l* and a right rear bearing element 9.*r*, which are carried by the bearing support 8 for the back of the head and are movable relative to one another and relative to the bearing support 8 for the back of the head,
- an intermediate piece 1, which connects the front bearing element 5 to the front holding element 2, and
- a rotatable handwheel 14 accessible from the outside for adjusting the head size of the safety helmet 100.

The visor and the additional visor are omitted in FIG. 3.

The left rear bearing element 9.*l* is connected to the front holding element 2 by a preferably detachable snap-in connection or screw connection 17.*l* and the right rear bearing element 9.*r* is connected to the front holding element 2 by a preferably detachable snap-in connection or screw connection 17.*r*. In addition, the two lateral rear bearing elements 9.*l*, 9.*r* are connected to the front bearing element 5, this connection being a detachable connection.

In one embodiment, two left, mushroom-shaped projections 20.*l* are arranged at the left free end of the front bearing element 5, and two right, mushroom-shaped projections 20.*r* are arranged at the right free end, and the respective projections mesh with two corresponding recesses 21.*l*, 21.*r* at the respective left and right lateral rear bearing element 9.*l*, 9.*r* and form a respective detachable snap-in connection 19.*l*, 19.*r* each. The front bearing element 5 can be connected hereby to the two lateral rear bearing elements 9.*l*, 9.*r* and be separated from same again without the use of a tool.

The front bearing element 5, the lateral rear bearing elements 9.*l*, 9.5, as well as the bearing support 8 for the back of the head form together a circular bearing ring, which fully or at least partially encompasses the head of a user of the safety helmet 100. The front bearing element 5 and the bearing support 8 for the back of the head are in contact with the head of the user in the exemplary embodiment, while the lateral rear bearing elements 9.*l*, 9.*r* have a distance from the head. By the user rotating the handwheel 14, the rear bearing elements 9.*l* and 9.*r* are moved synchronously towards one another or away from one another relative to the bearing support 8 for the back of the head, as a result of which the distance between the front bearing element 5 and the bearing support 8 for the back of the head and thereby the length of the bearing ring and hence the head size of the safety helmet 100 are changed.

A distance is formed between the front holding element 2 and the front bearing element 5 in the exemplary embodiment in an area BS that is located in front of the forehead of a user of the safety helmet 100. This distance influences the position of the center of gravity of the safety helmet 100 relative to the head of the user.

Figure 4:
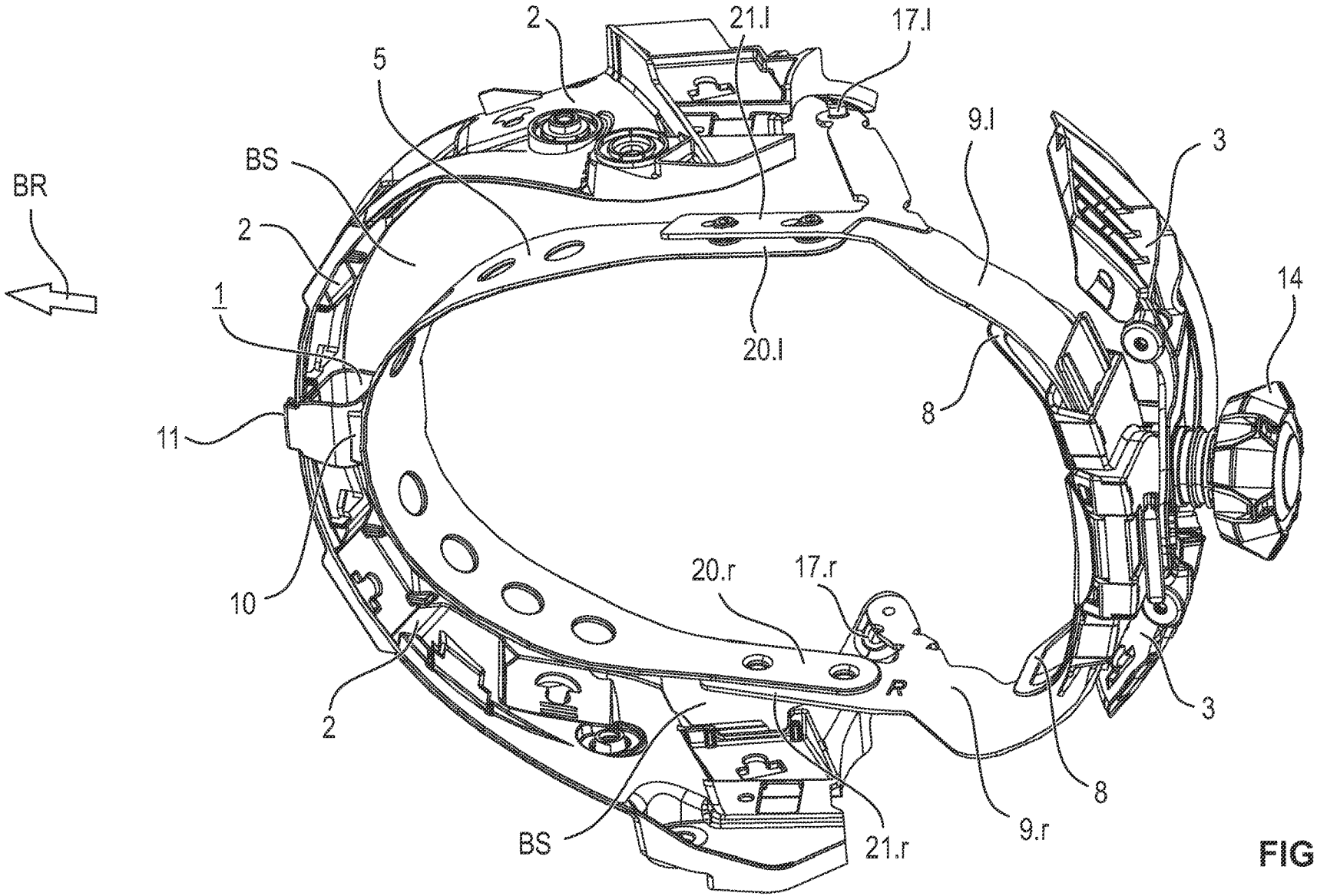
FIG. 4 is a perspective view showing the bearing structure of the safety helmet from FIG. 1 and from FIG. 2.
Figure 5A:
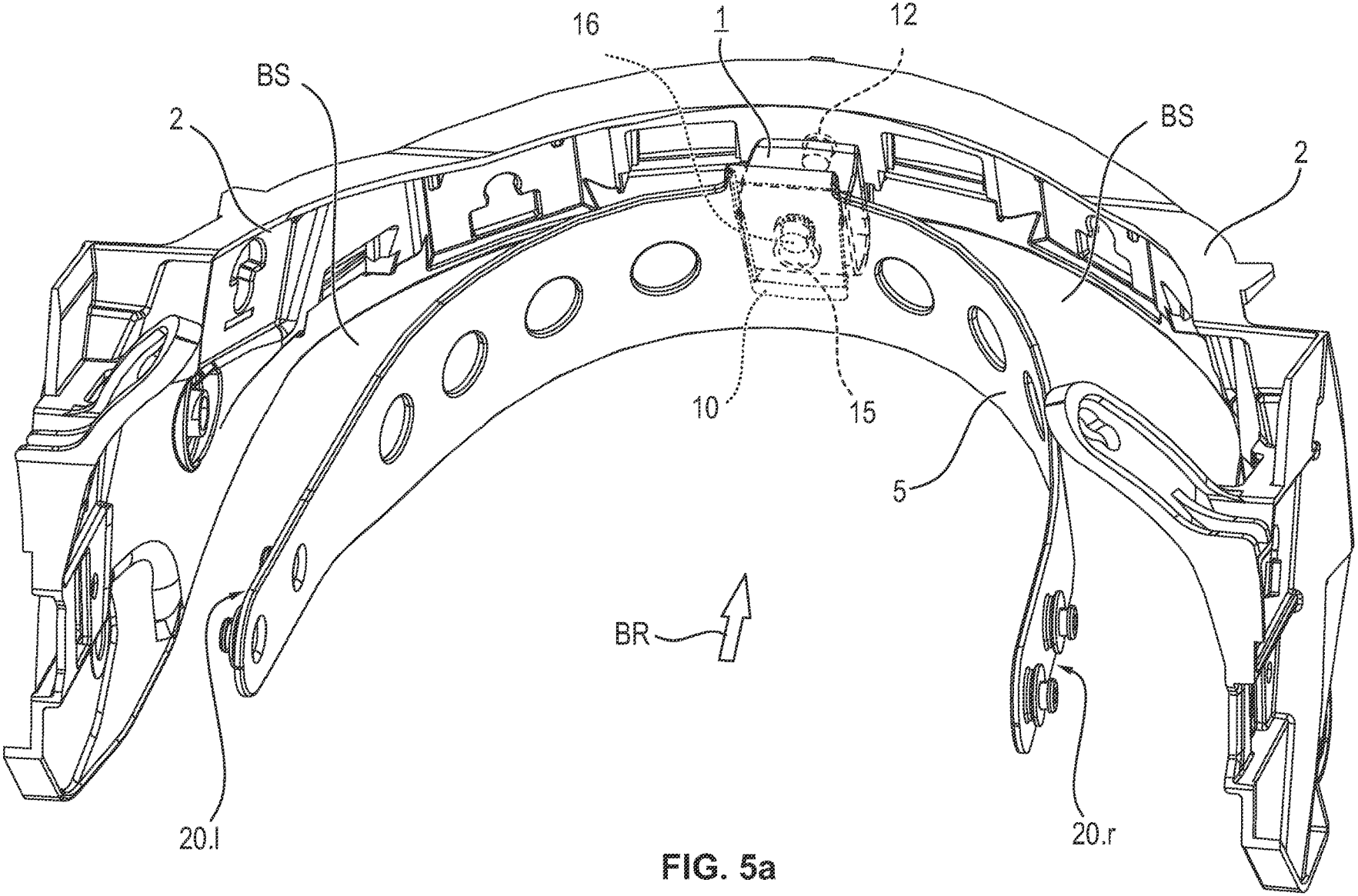
FIG. 5*a* is a perspective view showing the front holding ring, the front bearing ring and the intermediate piece of the bearing structure from FIG. 4 in an oblique viewing direction from behind.
Figure 5B:
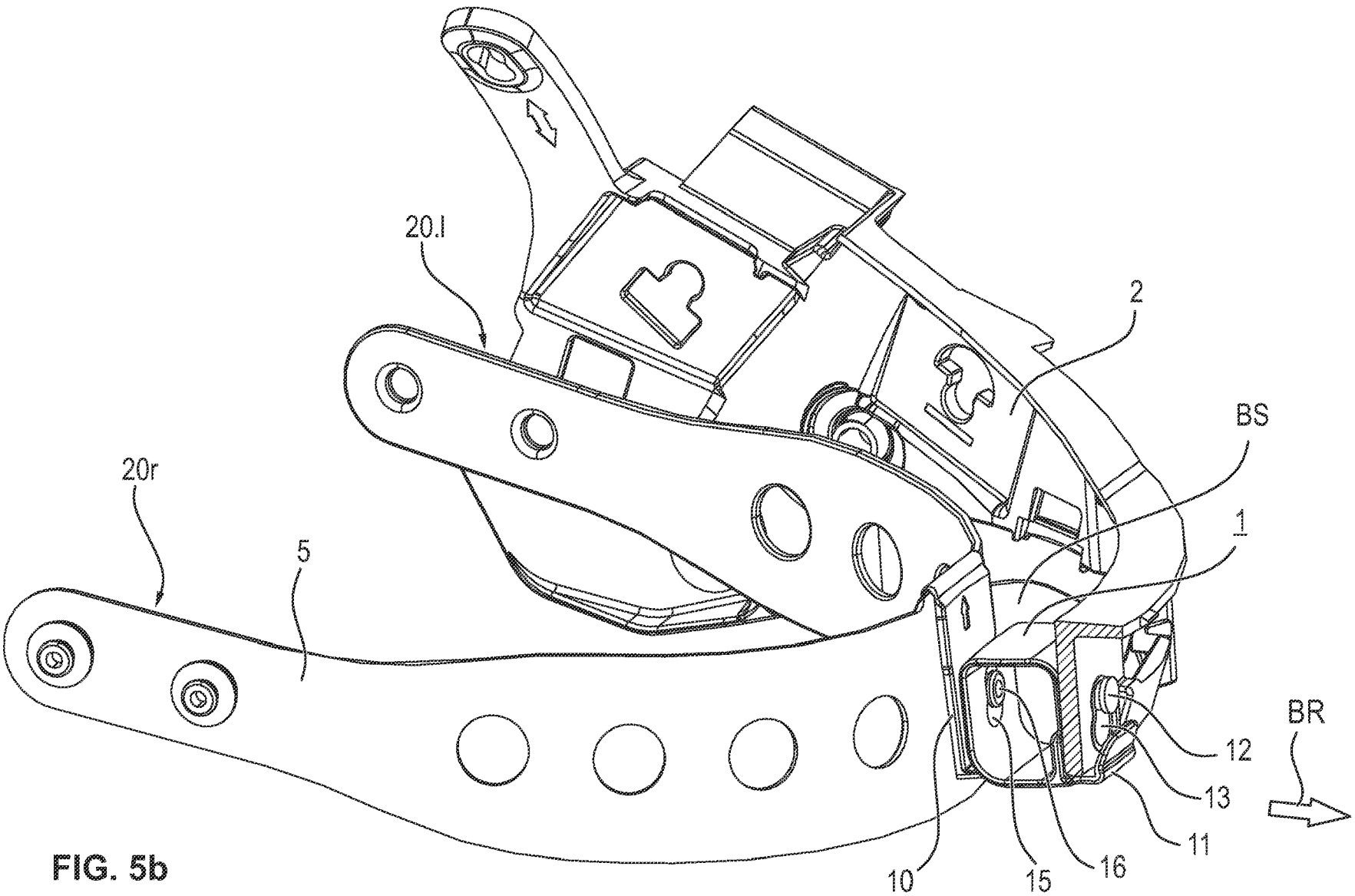
FIG. 5*b* is a partial sectional perspective view showing the front holding ring, the front bearing ring and the intermediate piece of the bearing structure from FIG. 4.
Figure 6:
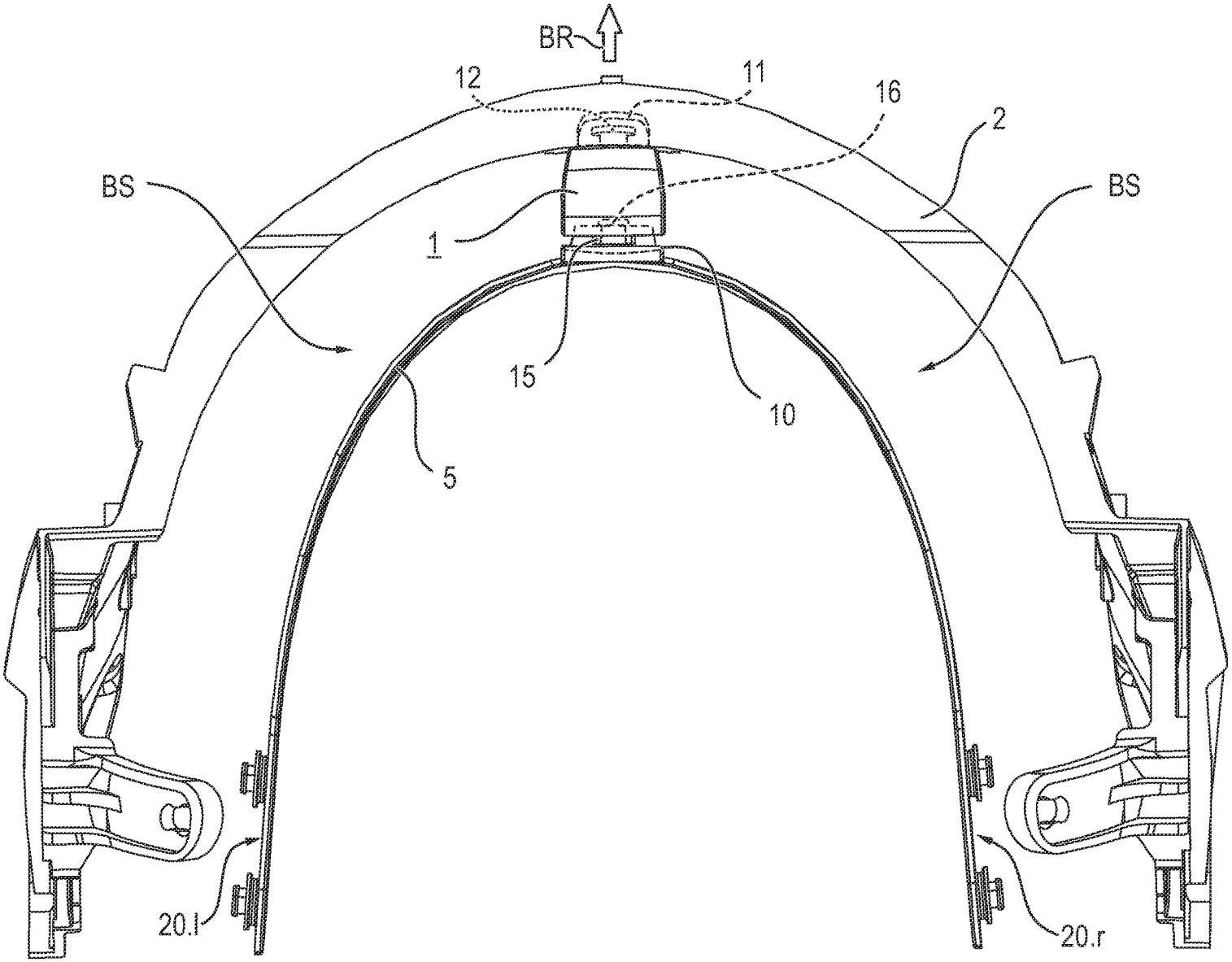
FIG. 6 is a top view showing the arrangement from FIG. 5*a;*
Figure 7:
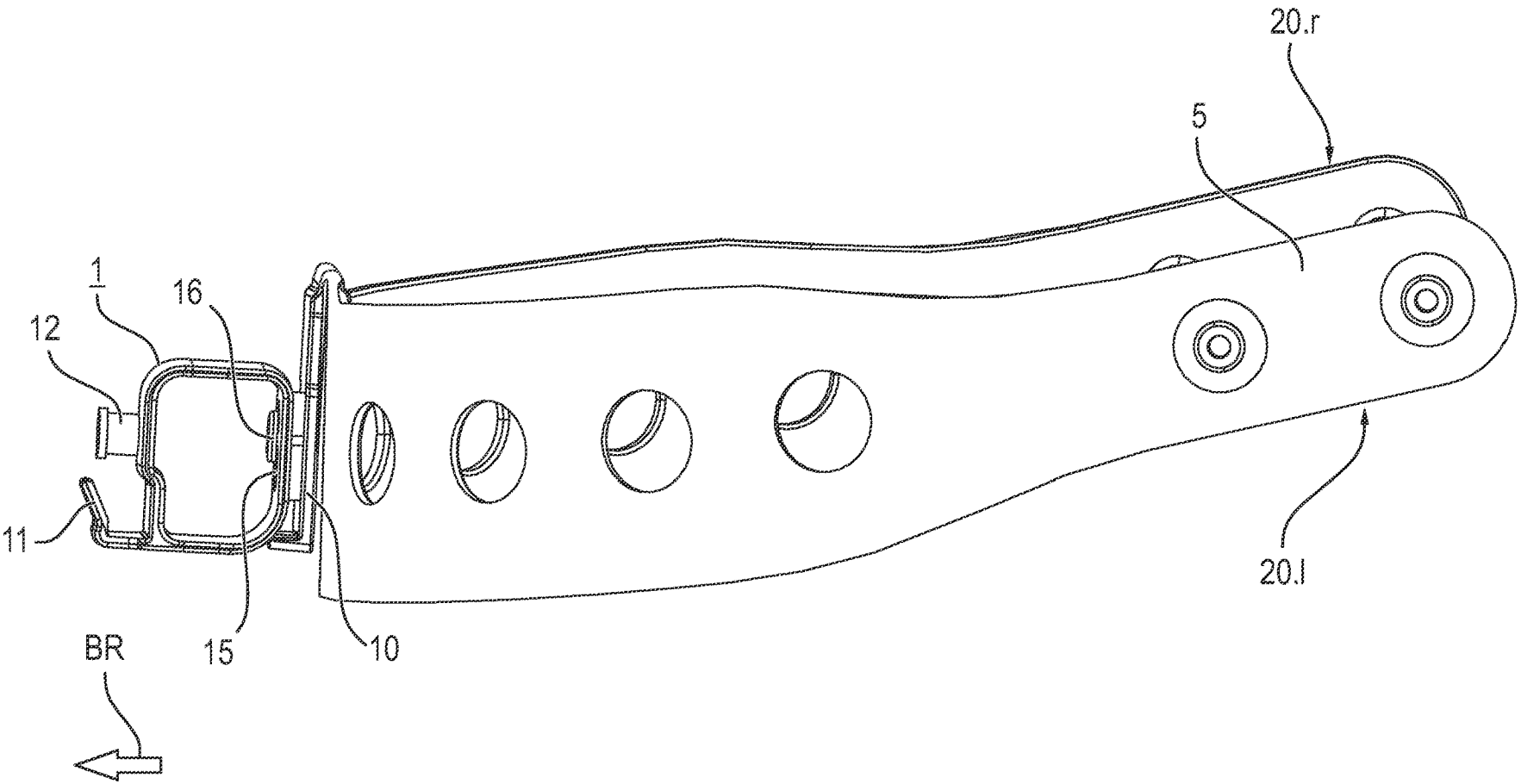
FIG. 7 is a perspective view showing the front bearing ring and the intermediate piece of the arrangement from FIG. 5 in a viewing direction from the side.
Figure 8:
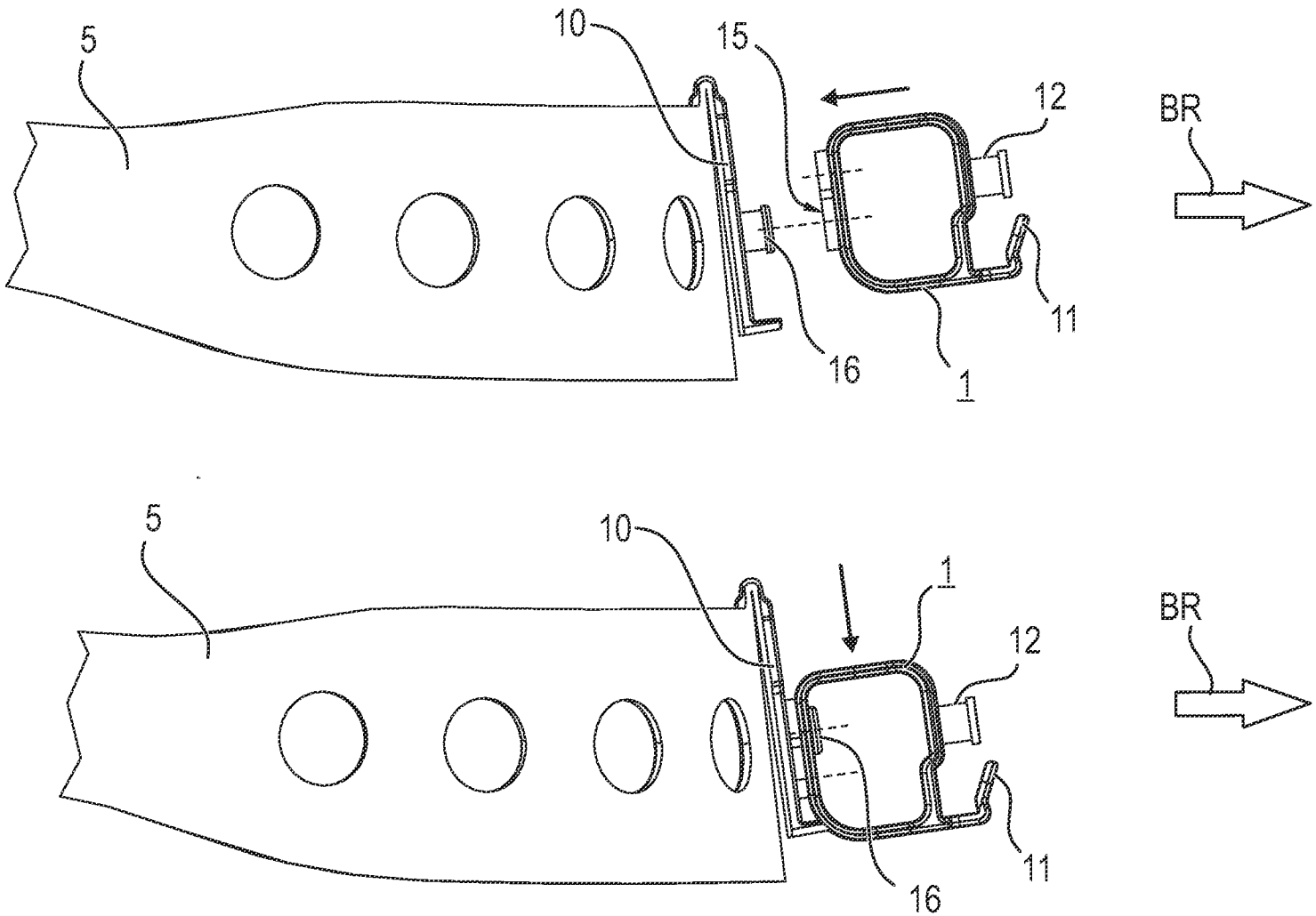
FIG. 8 is a side view showing the intermediate piece being placed on the opened reinforcing piece.
Figure 9:
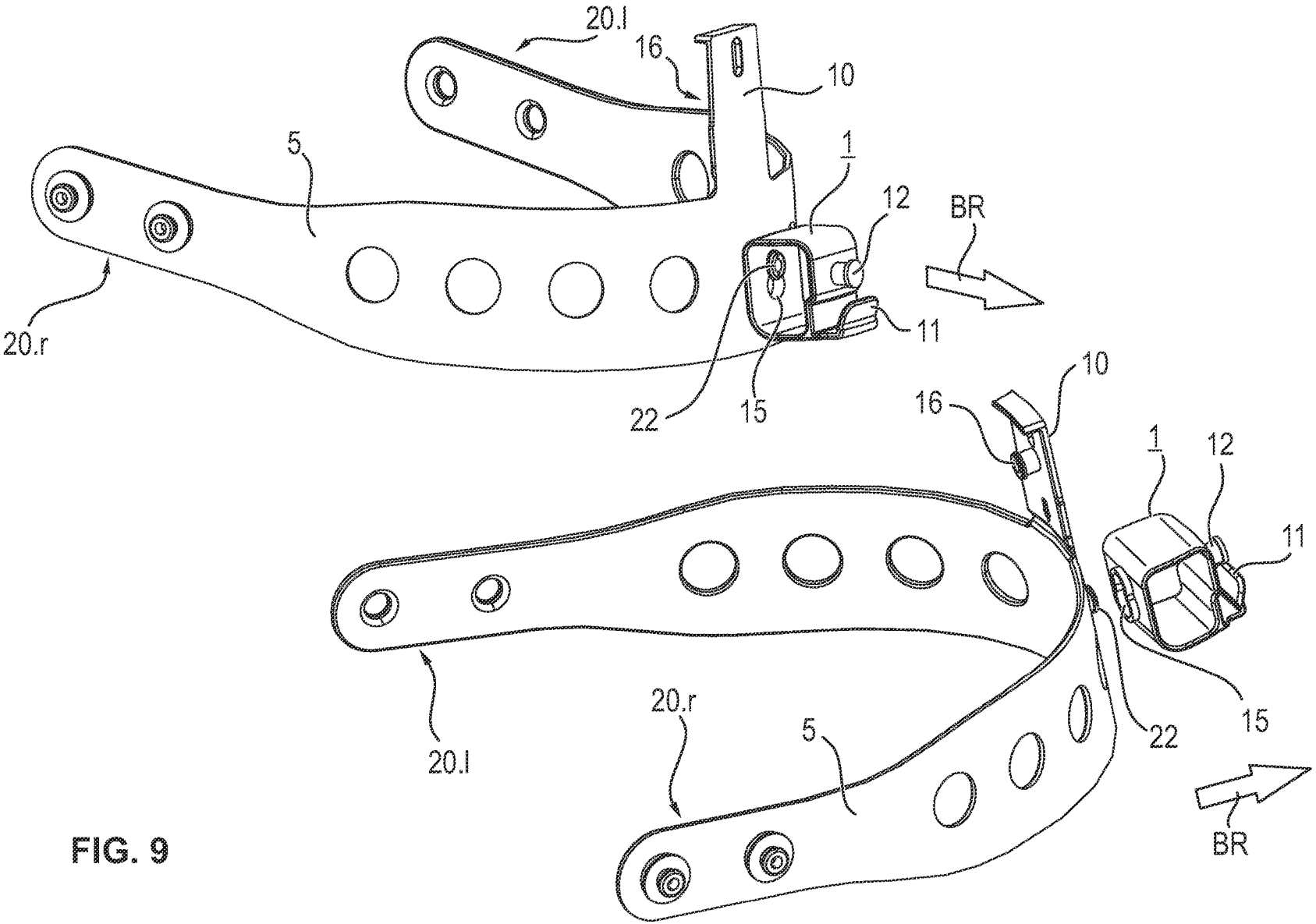
FIG. 9 is a perspective view showing the intermediate piece being placed on the front bearing element.
Figure 10:
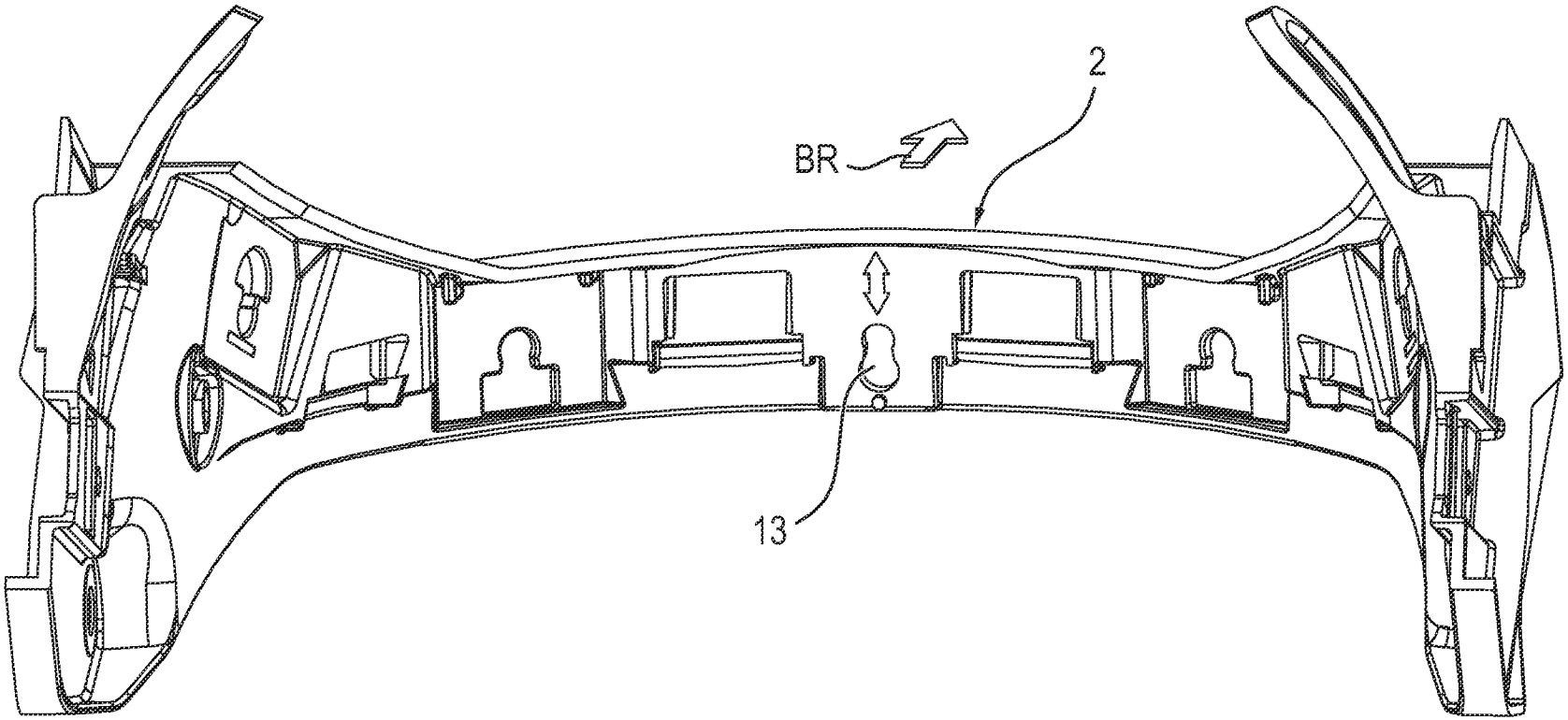
FIG. 10 is a rear view showing the front holding ring.
Figure 11:
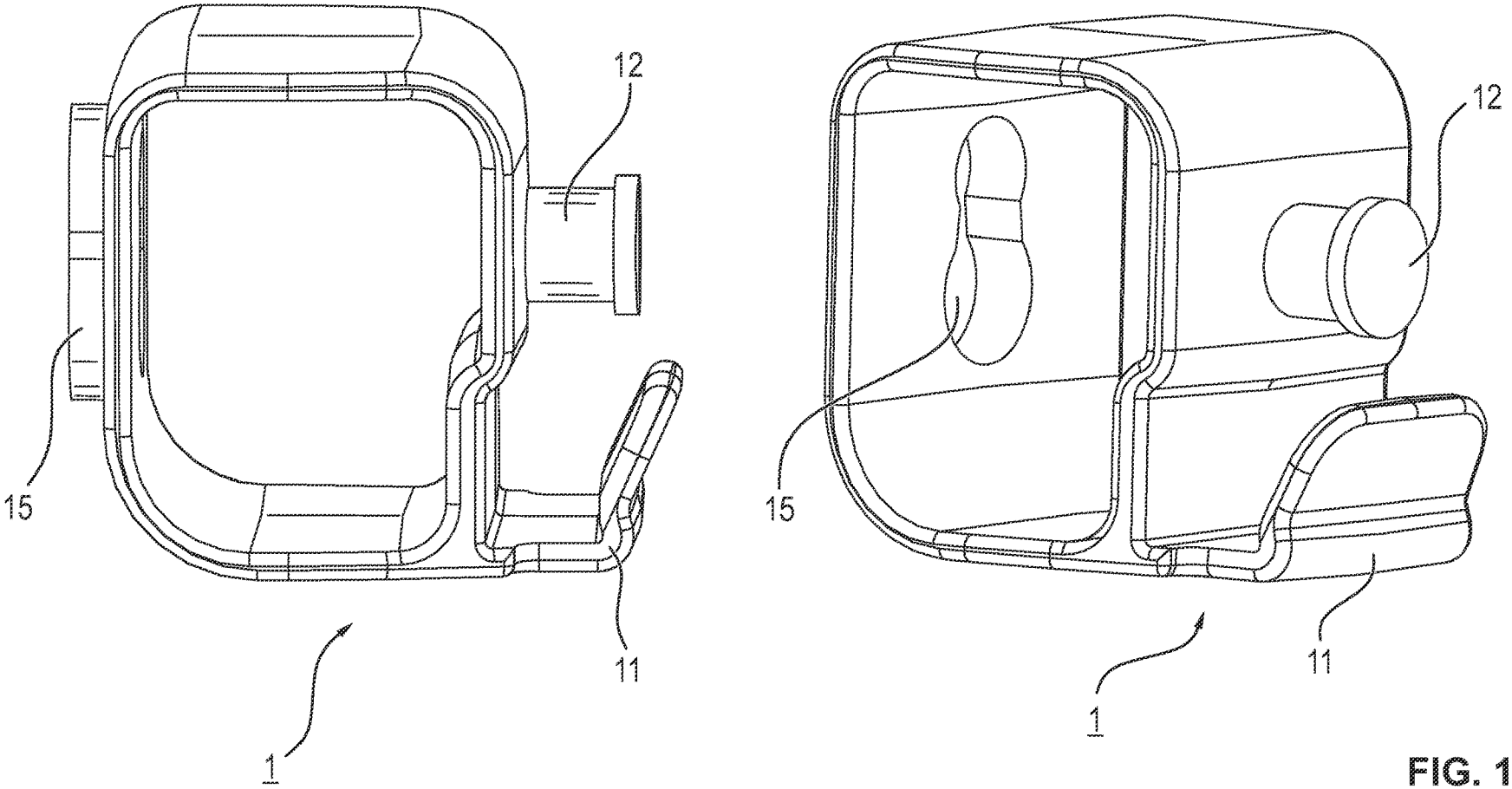
FIG. 11 is a perspective view showing the intermediate piece in two different viewing directions.

FIG. 4 shows the bearing structure of the safety helmet from FIG. 1, wherein especially the helmet shell 7 and the shock-absorbing shell 6 are omitted. FIG. 5 and FIG. 6 show in an oblique viewing direction from behind and from the front the front holding element 2, the front bearing element 5 and the rigid intermediate piece 1 of the bearing structure from FIG. 4. FIG. 7 and FIG. 8 show from two different lateral viewing directions the front bearing element 5 and the intermediate piece 1, wherein the reinforcing piece 10 is movable relative to the front bearing element 5 and is folded down. FIG. 9 shows from two lateral viewing directions an alternative embodiment, in which the connection piece 10 is permanently connected (fixed) to the front bearing element 5 and points upward. A mushroom-shaped projection, which has the same shape as the projection 16 at the connection piece 10, is mounted in the front at the front bearing element 5. FIG. 10 shows the front holding element 2 in a viewing direction from behind. FIG. 11 shows the intermediate piece 1 in two different viewing directions.

It can be seen that the intermediate piece 1 is arranged centrally at the front holding element 2 and centrally at the front bearing element and it mechanically connects the front holding element 2 to the front bearing element 5. In a first embodiment, the intermediate piece 1 is mechanically connected to the front bearing element 5 and can be separated again from the front bearing element 5. In a second embodiment, the intermediate piece 1 is permanently connected (fixed) to the front bearing element 5. In the second exemplary embodiment, the front bearing element 5 and the intermediate piece 1 form a single component, preferably even a monolithic component, i.e., a component that is manufactured by a single step during the manufacture of the safety helmet 100.

A hook-shaped projection 11 of the intermediate 1 encompasses the front holding element 2 from below and from the front. A forward-pointing, mushroom-shaped projection 12 of the intermediate piece 1 comprises a roof section and a butt section and is guided by a corresponding central recess 13 in the front holding element 2, cf. FIG. 5*b*. This central recess 13 comprises a larger hole and a smaller hole. The roof section of the projection 12 fits through the larger hole, but not through the smaller hole, so that the butt section of the projection 12 is fixed in the recess. The intermediate piece 1 is connected in this manner by a detachable snap-in connection to the front holding element 2.

The rear surface of the intermediate piece 1 comprises a central recess 15, which is identical in terms of shape and size to the central recess 13 in the front holding element 2. The reinforcing piece 10 located centrally in front of the front bearing element 5 carries a mushroom-shaped projection 16, which is identical in terms of shape and size to the forward-pointing, mushroom-shaped projection 12 at the intermediate piece 1. If the reinforcing piece 10 is folded down (FIG. 8 and FIG. 9), this mushroom-shaped projection 16 points forward.

The head size of the safety helmet 100 is set by the length of the circumferential bearing ring, which can be seen especially clearly in FIG. 1. This bearing ring comprises the front bearing element 5, the bearing support 8 for the back of the head and the lateral rear bearing elements 9.*l* and 9.*r*. The set head size of the safety helmet 100 as well as the head size and the head shape of a user of the safety helmet 100 have an influence on how the center of gravity of the safety helmet 100 is positioned relative to the head of the user.

The above-mentioned distance between the front holding element 2 and the front bearing element 5 likewise influences the position of the center of gravity of the safety helmet relative to the head of the user. The intermediate piece 1 prevents this distance from changing substantially, without the front bearing element 5 being connected over the entire length to the front holding element 2. In addition, it is desirable in some cases that this distance be greater than a preset minimum distance. A possible reason for this is that at least one display unit, which shall be located in the field of view of the user of the safety helmet 100, shall be attached to the visor 4 or to the helmet shell 7, or else the visor 4 itself is configured as such a display unit. For example, visual information can be outputted with this display unit to the user. In order for the user to be able to perceive information displayed on the output unit, the distance between the display unit and the eyes of the user must be greater than a minimum distance. This distance can be changed and especially increased sufficiently by changing the distance between the front holding element 2 and the front bearing element 5, How the distance and hence the center of gravity can be adapted will be described below.

The safety helmet 100 is preferably available commercially in at least two variants, namely, in at least one variant with an intermediate piece 1 and in a variant without an intermediate piece 1. The variant or each variant with an intermediate piece is suitable for a user with a smaller head and therefore a smaller head size and/or with a relatively short head, and the variant without an intermediate piece 1 is suitable for a user with a larger and/or longer head and therefore with a larger head size.

It is also possible that the safety helmet 100 is available commercially in at least three variants, namely, in at least two variants with different intermediate pieces 1 and one variant without an intermediate piece 1. The intermediate pieces 1 of the variant differ at least in their dimensions in a direction parallel to the viewing direction BR, so that these different intermediate pieces 1 can embody and bridge different distances between the front holding element 2 and the front bearing element 5.

In the variant without the intermediate piece 1, the front bearing element 5 is attached by means of the connection piece 10 additionally in a central connection point directly at the front holding element 2, preferably in a detachable manner. The mushroom-shaped projection 5 is guided for this purpose at the reinforcing piece 10 at the front bearing element 5 in the front through the recess 13 in the front holding element 2. As a result, there is a shorter horizontal distance, compared to a variant with the intermediate piece 1, between the front holding element 2 and the front bearing element 5. A horizontal distance that is bridged by the intermediate piece 1, as well as a shorter vertical distance develop in the area BS in front of the forehead of the user in the variant with the intermediate piece 1. It is also possible that no vertical distance is formed. If the safety helmet 100 is available commercially with at least two variants with a respective intermediate piece 1 each, and these variants differ by different intermediate pieces 1, this horizontal distance is preferably different from one variant to the next.

In the embodiment described so far, the intermediate piece 1 is configured as a relatively rigid component with constant dimensions. For example, it is manufactured from a metal or from a solid plastic. This embodiment leads to a construction that is mechanically relatively stable. This intermediate piece 1 embodies a distance set by the geometry of the intermediate piece 1 between the front holding element 2 and the front bearing element 5.

In a different embodiment, the dimension of the rigid intermediate piece 1 can be changed in a direction parallel to the viewing direction BR. As a result, the distance between the front holding element 2 and the front bearing element 5 can be changed as well, namely, by the extent of the intermediate piece 1 being correspondingly adapted, preferably by a continuous change. This alternative reduces the number of necessary variants of intermediate pieces because the same variant of a safety helmet 100 can provide different distances between the front holding element 2 and the front bearing element 5. This effect is achieved especially by the variable intermediate piece 1 being able to bridge different distances.

The recess 13 in the front holding element 2 is identical to the recess 15 in the intermediate piece 1 in terms of shape and size. An attaching element of the inner lining (not shown) can therefore be inserted optionally into the recess 13 (variant without intermediate piece 1) or into the recess 15 (variant with intermediate piece 1) and it then establishes a detachable snap-in connection.

While specific embodiments of the invention have been shown and described in detail to illustrate the application of the principles of the invention, it will be understood that the invention may be embodied otherwise without departing from such principles.

LIST OF REFERENCE CHARACTERS

- 1 Rigid intermediate piece between the front holding element 2 and the front bearing element 5; it comprises the hook-shaped projection 11, the mushroom-shaped projection 12 and the recess 15
- 2 Curved front holding element; it is in contact with the shock-absorbing shell 6; it comprises the recess 13
- 3 Rear holding element, mechanically connected to the helmet shell 7
- 4 Pivotable visor, attached to the front holding element 2
- 5 Front bearing element, detachably connected to the lateral rear bearing elements 9.*l*, 9.*r*
- 6 Arched shock-absorbing shell, located inside in the helmet shell 7; it absorbs kinetic energy
- 7 Arched helmet shell; it carries the front holding element 2 and the handwheel 14
- 8 Central rear bearing element in the form of a bearing support for the back of the head, arranged between the lateral bearing elements 9.*l* and 9.*r*
- 9.*l* Left rear bearing element, connected to the front bearing element 5 in an articulated manner
- 9.*r* Right rear bearing element, connected to the front bearing element 5 in an articulated manner
- 10 Reinforcing piece, arranged centrally in the front at the front bearing element 5; it is rotatable in one embodiment relative to the front bearing element 5 and is permanently connected to the front bearing element 5 in another embodiment; it comprises the mushroom-shaped projection 16

11 Hook-shaped projection of the intermediate piece 1; it encompasses the front holding element 2 from below and from the front

12 Mushroom-shaped projection at the intermediate piece 1; it is passed through the recess 13 in the front holding element 2

13 Central recess 13 in the front holding element 2, through which the cylindrical projection 12 is passed

14 Rotatable handwheel accessible from the outside for adjusting the head size of the safety helmet 100; it acts on the rear bearing elements 9.*l*, 9.*r*

15 Recess in the rear wall of the intermediate piece 1; it is identical in terms of shape and size to the recess 13 in the front holding element 2

16 Mushroom-shaped projection at the reinforcing piece 10

17.*l* Preferably detachable snap-in connection or screw connection between the front holding element 2 and the left rear bearing element 9.*l*

17.*r* Connection between the front holding element 2 and the right rear bearing element 9.*r*; it is preferably configured as a detachable snap-in connection or screw connection

18 Additional visor in the form of sunglasses, arranged between the visor 4 and the front holding element 2

19.*l* Snap-in connection between the front bearing element 5 and the left rear bearing element 9.*l*

19.*r* Snap-in connection between the front bearing element 5 and the right rear bearing element 9.*r*

20.*l* Mushroom-shaped projections at the left free end of the front bearing element 5; they belong to the snap-in connection 19.*l*

20.*r* Mushroom-shaped projections at the right free end of the front bearing element 5; they belong to the snap-in connection 19.*r*

21.*l* Recesses at the left rear bearing element 9.*l*; they belong to the snap-in connection 19.*l*

21.*r* Recesses at the right rear bearing element 9.*r*; they belong to the snap-in connection 19.*r*

22 Projection at the front bearing element 5.*m*; it has the same shape as the projection 16

100 Safety helmet; it comprises the helmet shell 7, the shock-absorbing shell 6, the front holding element 2, the rear holding element 3, the central rear bearing element (support for the back of the head) 8, the lateral rear bearing elements 9.*l* and 9.*r*, the handwheel 14 and the intermediate piece 1

BR Viewing direction of a user of the safety helmet 100 looking straight forward BS Area in front of the forehead of a user of the safety helmet 100, in which a distance is formed between the front holding element 2 and the front bearing element 5, wherein this distance is bridged by the intermediate piece 1

What is claimed is:

1. An arrangement comprising: a safety helmet comprising an arched helmet shell, a front holding element, which is attached to the helmet shell, and a curved front bearing element, wherein the safety helmet is configured such that the front bearing element, in an area in front of the forehead of a user, is contact with the head of the user of the safety helmet; a first rigid intermediate piece; and a second rigid intermediate piece, wherein: the front holding element is curved and the front holding element is attached on an inside to the helmet shell; both the first rigid intermediate piece and the second rigid intermediate piece are selectively mechanically connectable to the front holding element and to the front bearing element; the arrangement has a first configuration and a second configuration; a first distance is formed between the front holding element and the front bearing element in the first configuration; a second distance is formed between the front holding element and the front bearing element in the second configuration; the second distance is different from the first distance; in the first configuration the first rigid intermediate piece is mechanically connected to the front holding element and to the front bearing element, wherein the connection is detachable, and the first rigid intermediate piece bridges the first distance; and in the second configuration the second rigid intermediate piece is mechanically connected to the front holding element and to the front bearing element, wherein the connection is detachable, and the second rigid intermediate piece bridges the second distance.

2. An arrangement in accordance with claim 1, wherein:

the arrangement has a third configuration;

in the third configuration the front bearing element adjoins the front holding element without a distance at least in one area and the front bearing element is detachably and mechanically connected or connectable directly to the front holding element; and the front holding element is directly connected to the inside of the helmet shell.

3. An arrangement in accordance with claim 1, wherein:

the safety helmet further comprises:

two rear bearing elements; and a rear holding structure comprising a rear holding element attached to the helmet shell or two rear holding elements attached to the helmet shell;

each rear bearing element is directly mechanically connected to the rear holding structure;

the front bearing element is mechanically connected to the two rear bearing elements;

the front bearing element and the two rear bearing elements together form a bearing ring; and the bearing ring is configured to fully encompass the head of the user of the safety helmet.

4. An arrangement comprising: a safety helmet comprising an arched helmet shell, and a front holding element attached to the helmet shell, the front holding element being curved and attached on an inside to the arched helmet shell; a first curved front bearing element; a second curved front bearing element; a first rigid intermediate piece; and a second rigid intermediate piece, wherein: the first rigid intermediate piece is permanently connected to the first front bearing element; the second rigid intermediate piece is permanently connected to the second front bearing element; the arrangement has a first configuration and a second configuration, in the first configuration the first rigid intermediate piece is detachably connected to the front holding element, the first front bearing element is located in the interior of the helmet shell such that a first distance, which is bridged by the first rigid intermediate piece, is formed between the front holding element and the first front bearing element, and the safety helmet is configured such the first front bearing element, in an area in front of the forehead of a user, is in contact with the head of the user; and in the second configuration the second rigid intermediate piece is detachably connected to the front holding element, the second front bearing element is located in the interior of the helmet shell such that a second distance, which is different from the first distance and which is bridged by the second rigid intermediate piece, is formed between the front holding element and the second front bearing element, and the safety helmet is configured such that the second front bearing element, in an area in front of the forehead of the user, is in contact with the head of the user.

5. An arrangement in accordance with claim 4, wherein:

the safety helmet additionally comprises:

two rear bearing elements; and a rear holding structure comprising a rear holding element attached to the helmet shell or two rear holding elements attached to the helmet shell;

each rear bearing element is directly mechanically connected to the holding structure;

both the first front bearing element and the second front bearing element are detachably mechanically connectable to the two rear bearing elements;

in the first configuration the first front bearing element is mechanically connected to the two rear bearing elements and the first front bearing element and the two rear bearing elements together form a first configuration bearing ring, which fully encompasses the head of the user of the safety helmet, and in the second configuration the second front bearing element is mechanically connected to the two rear bearing elements and the second front bearing element and the two additional bearing elements together form a second configuration bearing ring, which fully encompasses the head of a user of the safety helmet.

6. An arrangement in accordance with claim 4, further comprising a third front bearing element for a third configuration, wherein:

in the third configuration the third bearing element adjoins the front holding element without a distance at least in one area and is detachably connected in the at least in one area to the front holding element; and the safety helmet is configured such that the third front bearing element, in an area in front of the forehead of the user, is in contact with the head of the user.

7. An arrangement in accordance with claim 1, wherein the front bearing element is located radially inward of the front holding element.

* * * * *